US005655378A

United States Patent [19]

Pettersen

[11] Patent Number: 5,655,378

[45] Date of Patent: Aug. 12, 1997

[54] TRANS-CRITICAL VAPOR COMPRESSION DEVICE

[75] Inventor: Jostein Pettersen, Ranheim, Norway

[73] Assignee: Sinvent A/S, Trondheim, Norway

[21] Appl. No.: 454,139

[22] PCT Filed: Dec. 8, 1993

[86] PCT No.: PCT/NO93/00185

§ 371 Date: Jun. 8, 1995

§ 102(e) Date: Jun. 8, 1995

[87] PCT Pub. No.: WO94/14016

PCT Pub. Date: Jun. 23, 1994

[30] Foreign Application Priority Data

Dec. 11, 1992 [NO] Norway ..... 924797

[51] Int. Cl.[6] ..... F25B 41/00; F25B 1/00

[52] U.S. Cl. ..... 62/174; 62/498

[58] Field of Search ..... 62/174, 115, 498

[56] References Cited

U.S. PATENT DOCUMENTS

| | | | |
|---|---|---|---|
| 1,408,453 | 3/1922 | Goosmann | 62/174 |
| 3,323,318 | 6/1967 | Fisher | 62/196 |
| 4,094,169 | 6/1978 | Schmerzler | 62/498 |
| 4,185,469 | 1/1980 | Rogers et al. | 62/174 |
| 4,205,532 | 6/1980 | Brenan | 62/115 |

FOREIGN PATENT DOCUMENTS

| | | | |
|---|---|---|---|
| 898 751 | 12/1953 | Germany . | |
| 30 30 754 | 2/1982 | Germany . | |
| 0193561 | 8/1989 | Japan | 62/115 |
| 90/07683 | 7/1990 | WIPO . | |
| 93/06423 | 4/1993 | WIPO . | |
| 93/13370 | 7/1993 | WIPO . | |

*Primary Examiner*—William E. Wayner
*Attorney, Agent, or Firm*—Wenderoth, Lind & Ponack

[57] ABSTRACT

A vapor compression system includes a compressor, a heat rejecting heat exchanger, an expansion device and an evaporator connected in series to form a closed circuit operating at supercritical pressure in a high pressure side of the circuit. A large part of the internal volume of the circuit is incorporated at or close to a refrigerant outlet from the heat exchanger. The actual refrigerant charge corresponds to an optimum overall density ensuring self-adaptation of the supercritical high-side pressure to maintain maximum energy efficiency at varying heat rejection temperatures of the heat exchanger.

7 Claims, 2 Drawing Sheets

TRANS-CRITICAL VAPOR COMPRESSION DEVICE

BACKGROUND OF THE INVENTION

The present invention relates to a vapour compression system operating at both subcritical and supercritical high-side pressures.

In conventional vapour compression systems, the high-side pressure is determined by the condensing temperature, via the saturation pressure characteristics of the refrigerant. The high side pressure in such systems is always well below the critical pressure.

In vapour compression systems operating with supercritical high-side pressure, i.e. in a trans-critical cycle, the operating pressure depends on several factors such as momentary refrigerant charge in the high side, component volumes and temperature of heat rejection.

A simple vapour compression system with an expansion device of conventional design, e.g. of the thermostatic type, would also be able to provide trans-critical cycle operation when the heat rejection temperature is above the critical temperature of the refrigerant. Such a system could give a simple and low-cost embodiment for a trans-critical vapour compression cycle using environmentally benign refrigerants such as $CO_2$. This simple circuit does not include any mechanisms for high-side pressure modulation, and the pressure will therefore be determined by the operating conditions and the system design.

A serious drawback in trans-critical operation of a system that is designed in accordance with common practice from conventional subcritical units is that, most likely, a relatively low refrigerating capacity and a poor efficiency will be obtained, due to far from optimum high side pressures during operation. This will result in a considerable reduction in capacity as supercritical conditions are established in the high side of the circuit. The loss in refrigerating capacity may be compensated for by increased compressor volume, but then at the cost of significantly higher power consumption and higher investments.

Another major disadvantage in trans-critical operation of a conventionally designed system is that leakage of refrigerant will immediately affect the high side pressure, due to the reduction in high-side charge. At supercritical high side conditions, the pressure is determined by the relation between instant refrigerant charge and component volumes, similar to the conditions in a gas-charged pressure vessel.

Still another disadvantage is that excessive pressures can easily build up in a fully charged non-operating system subjected to high ambient temperatures. The latter effect can cause damage, or can be taken into account in the design, but then at the cost of heavy, voluminous and expensive components and tubes.

It is therefore a major object of the present invention to provide a simple, efficient and reliable vapour compression system avoiding these and other shortcomings.

BRIEF DESCRIPTION OF THE DRAWINGS

This and other objects and features of the invention are discussed in more detail below with reference to the accompanying drawings, wherein.

DETAILED DESCRIPTION OF THE INVENTION

Figure 1:
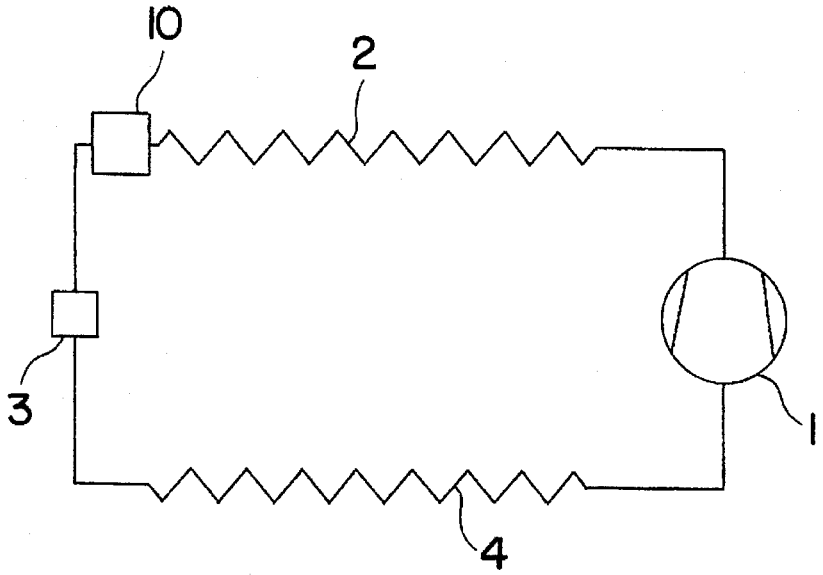
FIG. 1 is a schematic illustration of a conventional vapour compression circuit modified in accordance with one embodiment of the invention.

Referring to FIG. 1 a conventional vapour compression circuit includes a compressor 1, a heat rejecting heat exchanger 2, an expansion device 3 and an evaporating heat exchanger 4 connected in series.

During trans-critical cycle operation of such circuit, a high-side pressure providing a maximum ratio between refrigerating capacity and compressor shaft power should be provided. A major parameter in the determination of the magnitude of this "optimum" pressure level is the refrigerant temperature at the outlet of the heat rejecting heat exchanger 2, i.e. the gas cooler. The most desirable relation between refrigerant temperature at the gas cooler outlet and the high side pressure, in order to maintain maximum energy efficiency of the circuit, can be calculated from thermodynamic data for the refrigerant or by practical measurements.

It can be shown that this relation between temperature and pressure can be closely approximated by an isochoric (constant-density) curve, i.e. the functional relation between temperature and pressure assuming constant density (mass per unit volume) of the refrigerant. The average fluid density is given by the instant refrigerant charge divided by the internal volume of the components.

Figure 2:
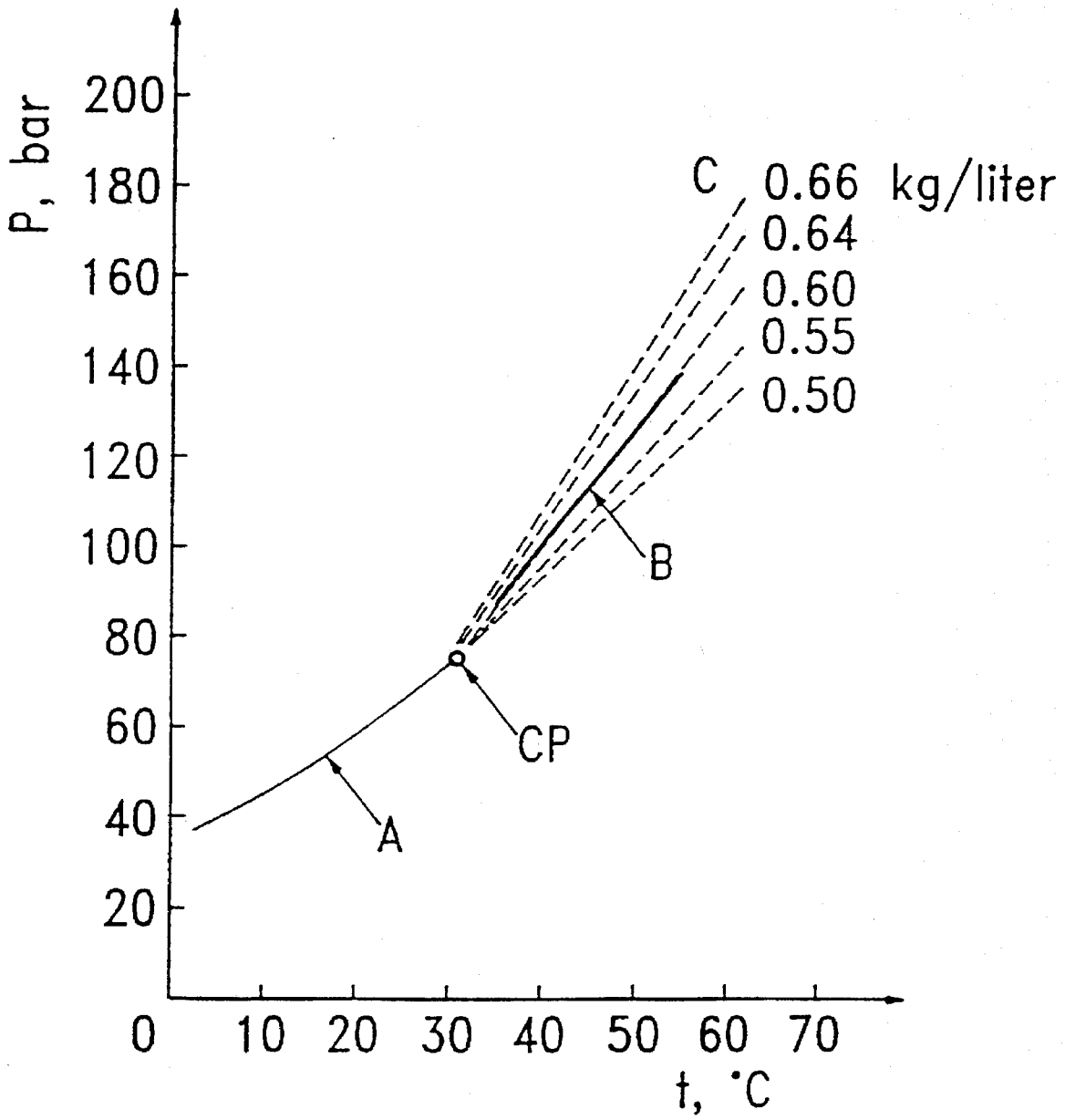
FIG. 2 is a graphical illustration of the relationship between a gas cooler refrigerant outlet temperature and a high-side pressure of such circuit at supercritical conditions.

As an example related to an actual refrigerant, the conditions for $CO_2$ are shown in FIG. 2. Isochoric curves for 0.50–0.66 kg/l are indicated by dashed lines C, and the curve giving an optimum relation between gas cooler refrigerant outlet temperature and high-side pressure is shown in the diagram as curve B, while curve A depicts a saturation pressure curve for subcritical conditions. For $CO_2$, the isochor corresponding to a high-side charge of about 0.60 kg/l is quite close to the optimum-pressure curve. If the high side of the system is charged with 0.60 kg of $CO_2$ per liter internal volume, close to maximum efficiency will be maintained regardless of heat rejection temperature.

Provided that the high-side of the circuit has an internal volume and an instant refrigerant charge that gives this desired density, changes in heat rejection temperature will result in high-side pressure changes corresponding quite accurately with the desired "optimum" curve. To make certain that the temperature at or near the gas cooler refrigerant outlet is the primary factor in this pressure adaptation, the volume of refrigerant should be relatively large at this location. In practice, this can be obtained by installing or connecting an extra volume, e.g. a receiver 10 (FIG. 1), into the circuit at or close to the gas cooler refrigerant outlet, or by providing a relatively large part 11 (FIG. 3) of the total heat exchanger volume at or near the outlet.

As long as the volume of the low-side of the circuit is relatively small in relation to the high-side volume, disturbances in high-side charge caused by low-side charge variation at varying operating conditions are insignificant. The low side of the circuit mainly comprises the evaporator, the low-pressure lines and the compressor crankcase.

In short, the high-side volume should be relatively large compared to the low-side volume, and a major fraction of the high-side volume should be located at or near the gas cooler outlet. A charge-to-volume ratio (density) $P_H$ in the high side giving the desired temperature-pressure relationship at varying temperatures may be found, as indicated in the above example for $CO_2$. The relation is as follows:

$$\rho_H = m_H / V_H$$

where $m_H$ is the instant refrigerant charge (mass) in the high side and $V_H$ is the total internal volume of the high-pressure side of the circuit. As long as the low-side volume $V_L$ and thereby also the low-side charge $m_L$ are small in relation to $V_H$ and $m_H$, respectively, $\rho_H$ will be quite close to the overall charge-to-volume ratio $\rho$ for the entire system. In other words:

$$V_L \ll V_H$$
$$m_L \ll m_H$$
$$m = m_H + m_L$$
$$V = V_H + V_L$$
$$m \simeq m_H$$
$$V \simeq V_H$$
$$\rho \simeq \rho_H$$

where m, V and $\rho$ refer to the overall charge, volume and resulting average density for the entire circuit. If a conventional vapour compression system is designed in accordance with these principles, efficient operation with sufficient capacity can be maintained also at supercritical high-side pressures. Calculations and conducted tests indicate that the internal volume of the high pressure side should be at least 70% of the total internal volume of the circuit.

Figure 3:
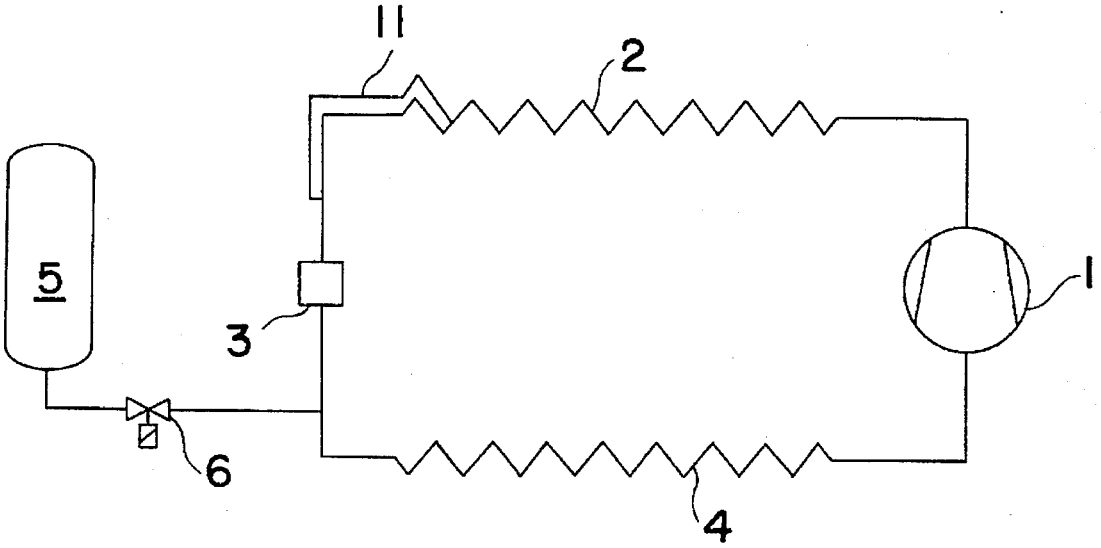
FIG. 3 is a schematic illustration of a preferred embodiment of a transcritical vapour compression cycle device constructed in accordance with the present invention.

In order to avoid excessive pressures in the system during shut-down at high ambient temperatures, a separate expansion vessel 5 can be connected to the low side via a valve 6, as shown in FIG. 3. The valve is opened when the pressure in the circuit exceeds a certain pre-set maximum limit in a manner known per se.

When the low-side pressure is reduced during start-up of the system, the valve 6 is opened and the necessary charge returned to the circuit, in order to re-establish the desired charge-to-volume ratio in the high side. The valve 6 is shut when the high-side pressure has reached the desired level in correspondence with the measured refrigerant temperature at the gas cooler outlet. Other parameters than the gas cooler refrigerant outlet temperature can also be employed in determining the valve shut-off pressure.

Furthermore, by giving the expansion vessel 5 a slightly larger inventory charge than necessary during normal operation, a certain refrigerant reserve can be maintained to enable compensation for leakage from the circuit.

I claim:

1. A vapour compression system comprising:

a compressor, a heat rejecting heat exchanger, an expansion means, and an evaporator connected in series forming a closed circuit, operating at supercritical pressure in a high pressure side of said circuit, an internal volume of said high pressure side of said closed circuit representing at least 70% of a total internal volume of said closed circuit.

2. A system as claimed in claim 1, having carbon dioxide as a refrigerant, and wherein a charge of said refrigerant in said closed circuit amounts to from 0.55 to 0.70 kg per liter of said total internal volume of said closed circuit.

3. A system as claimed in claim 2, wherein said heat rejecting heat exchanger has a substantial share of an internal volume thereof located at or close to a refrigerant outlet thereof.

4. A system as claimed in claim 2, wherein an extra volume is incorporated in or connected to said closed circuit at or close to a refrigerant outlet from said heat exchanger.

5. A system as claimed in claim 1, further comprising a separate pressure relieving and leakage compensating expansion vessel connected via a valve to a low pressure side of said closed circuit.

6. A system as claimed in claim 1, wherein said heat rejecting heat exchanger has a substantial share of an internal volume thereof located at or close to a refrigerant outlet thereof.

7. A system as claimed in claim 1, wherein an extra volume is incorporated in or connected to said closed circuit at or close to a refrigerant outlet from said heat exchanger.

* * * * *